United States Patent [19]

Hegemann

[11] Patent Number: 4,660,782

[45] Date of Patent: Apr. 28, 1987

[54] PORTABLE REEL FOR FLEXIBLE CONDUITS

[76] Inventor: Kenneth J. Hegemann, R.R. 1, Box 69, Newman Grove, Nebr. 68758

[21] Appl. No.: 830,273

[22] Filed: Feb. 18, 1986

[51] Int. Cl.[4] ..... B65H 75/38; B65H 49/02; A62C 35/00

[52] U.S. Cl. ..... 242/86; 242/77; 242/96; 242/128; 137/355.26

[58] Field of Search ..... 242/85, 85.1, 86, 86.1, 242/86.2, 96, 82, 128, 129, 77, 77.2, 77.3, 77.4; 137/355.16, 355.26

[56] References Cited

U.S. PATENT DOCUMENTS

| | | | |
|---|---|---|---|
| 3,433,247 | 3/1969 | Haselden | 137/355.26 |
| 3,659,802 | 5/1972 | Agonis | 242/128 |
| 3,840,713 | 10/1974 | Carpentier | 242/85.1 X |
| 3,889,896 | 6/1975 | O'Hara | 242/86 |
| 4,253,624 | 3/1981 | Colbert | 242/128 |

*Primary Examiner*—John M. Jillions
*Assistant Examiner*—David Werner

[57] ABSTRACT

The portable reel has a non-rotatable spool extending longitudinally forwardly from a rearward mount and which surrounds a rotatable spindle extending along a lineal longitudinal-axis. An elongate radial arm is co-rotatably attached to the spindle, and the arm first-end is rigidly attached to a manually graspable tubular guide for flexible conduit carried by the spool. The tubular guide has an internally unencumbered and axially curved bore that preferably terminates as flared configuration terminal openings. As seen in top plan view and at the stage when the arm first-end is strictly vertically below the spindle, the tubular guide curved-axis and the spindle longitudinal-axis have an angular relationship within the range of about 5° to 20°.

12 Claims, 5 Drawing Figures

FIG. 1
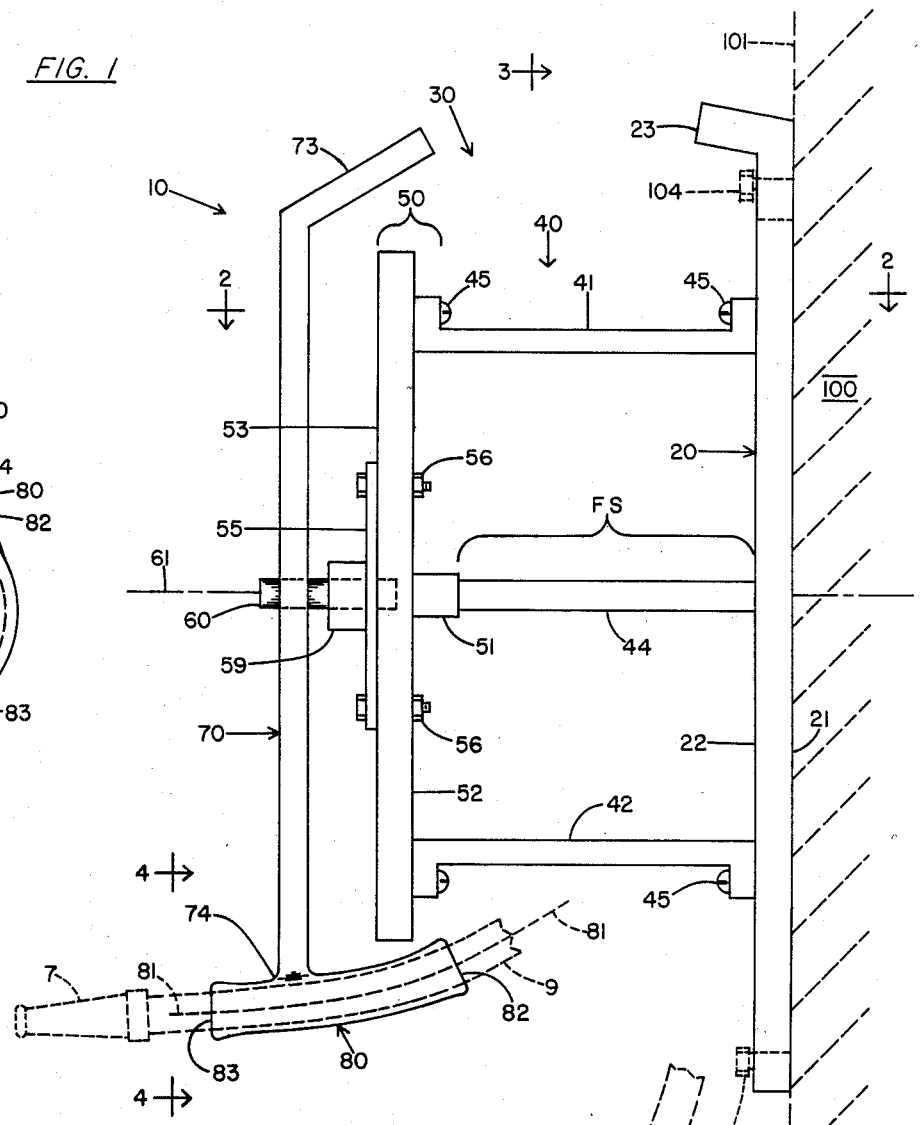
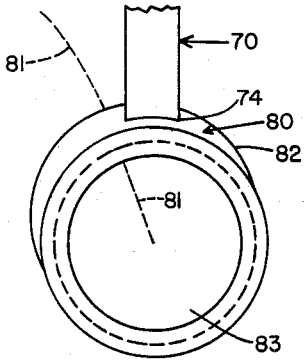
FIG. 4
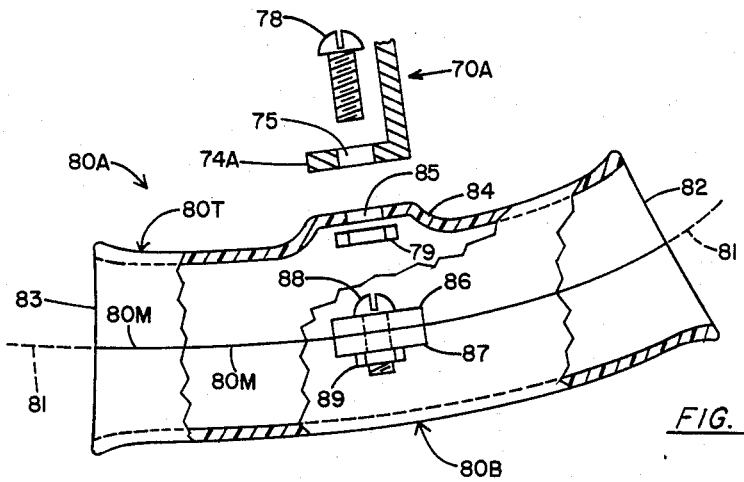
FIG. 5

PORTABLE REEL FOR FLEXIBLE CONDUITS

BACKGROUND OF THE INVENTION

As typified by U.S. Pat. No. 3,840,713, portable reels for flexible conduits generally comprise a suitably supportable non-rotatable spool surrounding a rotatable spindle, the spindle being provided with an elongate arm which at a first-end is attached to manually graspable tubular guide for flexible conduit being wound onto or unwound from the spool. However, portable reels of the prior art suffer from one or more of the following disadvantages or deficiencies. Some are not conveniently and reliably mountable to an upright wall or post type environments. Others are too bulky or too heavy for ready portability or for economical shipment. Many employ excessively cumbersome and expensive components and component inter-relationships. One example of the latter is the employment of complicated and internally encumbered manually graspable tubular guides for the flexible conduit.

OBJECT OF THE INVENTION

In view of the foregoing, it is the general objective of the present invention to provide improed portable reels for various flexible conduits and which overcome the several disadvantages and deficienies of the prior art. Ancillary general objective include the provision of portable reels that: are also adaptable to a mode for convenient and reliable removable anchoring to walls and similar upright environments; are amenable to inexpensive manufacture and shipment, and to very ready portability; and having a reliable and unencumbered manually graspable tubular guide for the flexible conduit.

GENERAL STATEMENT OF THE INVENTION

With the above mentioned general objectives in view, and together with other ancillary and related objectives which will become come more apparent as this description proceeds, the portable reel concept of the present invention generally comprises: a non-rotatable spool upon which a selectable flexible conduit may be wound or unwound, said spool hub extending forwardly from a selectable mount (which might take a preferable bracket mode appropriate to a wall or post environment) and surrounding a longitidinal-axis and along which is positioned a rotatable spindle; an elongate radial arm co-rotatably attached to the spindle, the arm first-end being rigidly attached to a manually graspable tubular guide for the conduit; and the tubular guide having an internally unencumbered and axially curved bore and terminating as preferably flared open ends, and, as seen in top plan view when the arm first-end is at a stage strictly vertically below the spindle, the tubular guide curved-axis and the spindle longitudinal-axis have an angular relationship within the range of 5° to 20°, and preferably substantially 10°.

BRIEF DESCRIPTION OF THE DRAWING

In the drawing, wherein like characters refer to like parts in the several views, and in which:

FIG. 1 is a right side elevational view of a representative embodiment (10) of the portable reel concept of the present invention, the left side elevational view (not shown) being a substantial mirror image thereof;

In FIGS. 1 and 2, phantom lines depict a representative selectable flexible conduit and typical environment for portable reel embodiment 10;

FIG. 4 is a detail sectional elevational view taken along line 4—4 of FIG. 1; and FIG. 5 is a detail right side elevational view, partly in section, and relating to an alternate embodiment tubular guide component for the portable reel of the present invention.

DETAILED DESCRIPTION OF THE DRAWING

Figure 2:
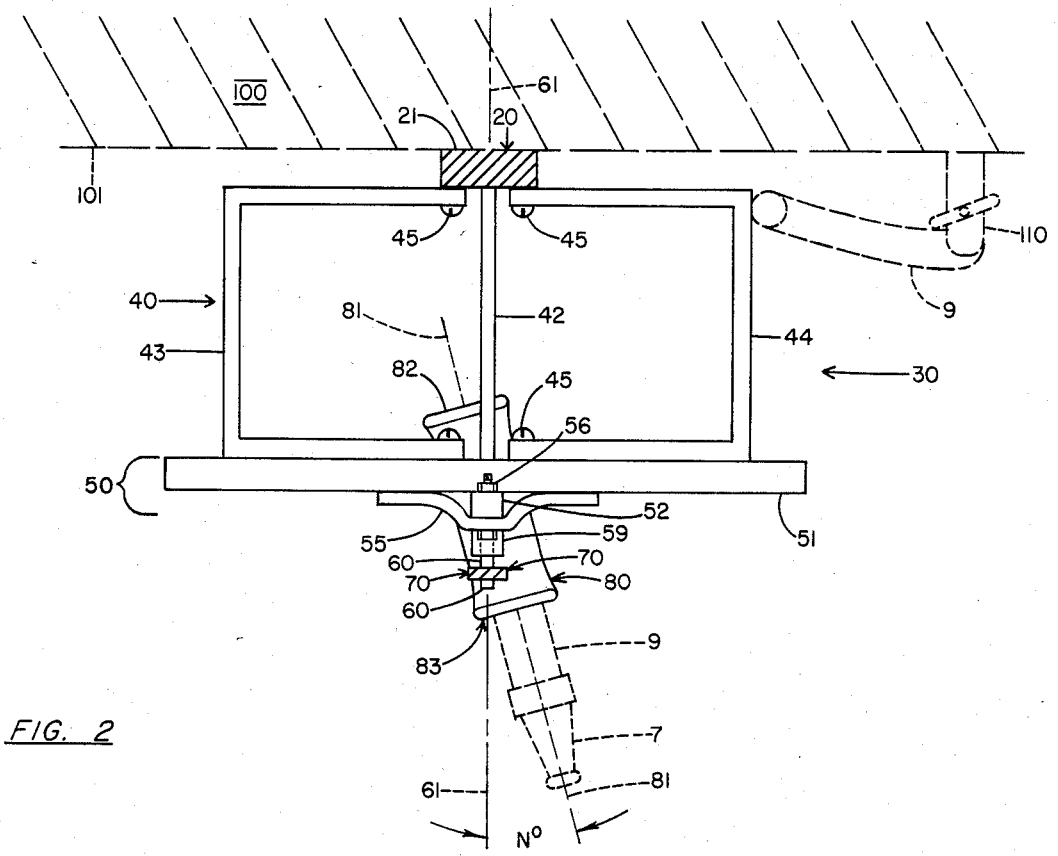
FIG. 2 is a sectional plan view taken along line 2—2 of FIG. 1.
Figure 3:
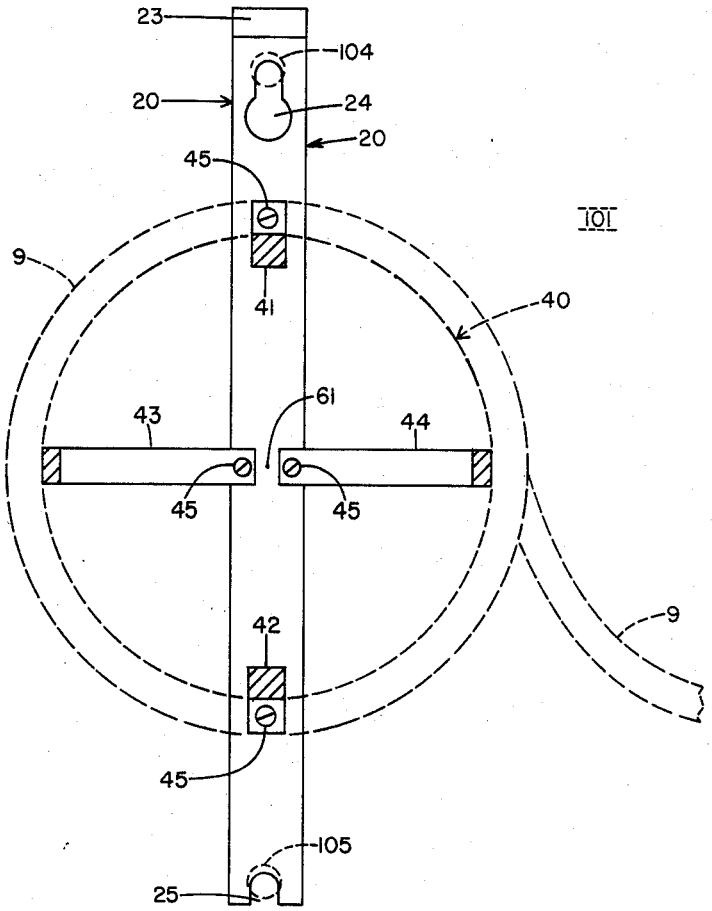
FIG. 3 is a sectional elevational view looking rearwardly and taken along line 3—3 of FIG. 1.

Phantom lines in drawing FIGS. 1 and 2 depict a representative, though non-limiting, type of flexible conduit which might be wound onto and unwound from portable reels of the present invention. 9 indicates a flexible garden hose having a nozzle at one end and having a coupling 8 at the other end for removable engagement to a plumbing spigot 110. Phantom lines also depict an arbitrarily selected environment for the portable reels. Herein, 100 indicates an upright environment such as a dwelling home wall having a vertical external surface 101. 104 and 105 indicate headed nails driven into wall 100 and extending horizontally forwardly therefrom.

Portable reel embodiment 10 of FIGS. 1–4 generally comprises: a non-rotatable spool means 30 extending forwardly from a mount 10, the spool hub being denoted as 40 and the spool rims being denoted as 20 and as 50; the hub 40 for convoluted flexible conduit (e.g. 9) surrounding a longitudinal-axis 61 and along which is positioned a rotatable spindle (e.g. 60); an elongate radial arm co-rotatably attached to the spindle and having a first-end 74 rigidly attached (as by welding, etc.) to a manually graspable guide for the flexible conduit; and the tubular guide having a curved-axis (81) bore terminating at preferably flared terminal openings 82 and 83 having special relationships to each other, to the elongate arm, to the spindle longitudinal-axis 61, and to the spool means frontal-rim.

For portable reel embodiment 10, 20 indicates a reel mount herein taking the selectable mode of an upright bracket having laterally separated ends including a top-end 23 and having a pair of opposed upright surfaces including forward-surface 22 and a rear-surface 21 abuttable against wall surface 101. Bracket 20 includes an upper keyhole aperture 24 and a slotted (25) bottom-end whereby reel bracket 20 might be removable stably anchored to headed wall extensions 104 and 105. Facilitating the ease of such removable stable anchoring is the forwardly extending top-end 23 for bracket mount 20.

For the embodiment 10 non-rotatable spool means 30, mount 20 (aided by wall 100) functions as the spool rearward-rim, perpendicularly intersecting elongate bars 51 and 52 function as the frontal-rim 50, and struts 41–44 intervening between mount 20 and frontal-rim 50 function as the spool hub 40. Specifically, the angularly C-shaped struts 43 and 44, and together occupying a transversely extending horizontal plane, are herein removably (45) attached to horizontal-bar 51. Moreover, the predominately straight struts 41 and 42, and together occupying a laterally extending vertical plane, are herein removably (45) attached to vertical-bar 52. Intervening spool hub 40, which surrounds horizontally extending longitudinal-axis 61, establishes a finite-spacing "FS" whereby confolutely wound flexible conduit might be stored between the spool rims 20 and 50.

The rotatable spindle (e.g. 60), and which necessarily extends substantially colinear to longitudinal-axis 61, is rotatably journalled by a suitable bearing or bushing member. An especially economical apt bushing or bearing might take the form of a resinous frontal-plate 55 extending along the spool upright frontal-face 53 and herein removably attached to frontal-rim bar 52 with mechanical fasteners 56. The frontal-plate frontal projection 59 journals rotatable spindle 60. If desired, a rearwardly lengthened version of such spindle might be additionally revolvably supported adjacent to the spool rearward-rim.

Co-rotatably attached to said spindle (e.g. 60) is an elongate radial arm 70 that is located frontally of and extends substantially parallel to the spool frontal-rim 50. Elongate arm 70 includes a radially outward first-end 74, the radial extent of which is at least substantially equivalent to that for the spool frontal-rim. Elongate arm 70 might also have a similarly radially remote second-end and which might have a rearwardly extending terminal length (73) for urging conduit convolutions toward spool hub 40.

There is a manually graspable tubular guide for the flexible conduit, a spine portion of which is rigidly attached to said elongate arm first-end (e.g. 74). The tubular guide bore extends along a curved axis 81 and terminates as an outlet-opening 83 and as an inlet-opening 82. The tubular guide curved-axis (81) is defined as follows. When the radial arm first-end (i.e. and equipped with the tubular guide) is at a rotational stage located strictly vertically below the rotatable spindle, the curved-axis 81:

in elevation (e.g. FIGS. 1 and 5) is downwrdly convex; and in plan view (e.g. FIG. 2) is at an angular relationship N°, with respect to the longitudinal-axis 61, within the range of about 5° to 20°, and with 10° being near optimal.

Such convex configuration ensures that the tubular guide central portion (e.g. at 74) is located radially outwardly of the spool frontal-rim (50) and that the inlet-opening (82) thereof is located both radially inwardly and longitudinally rearwardly of the spool frontal-rim. And such axes angular inter-relationship ensures that the tubular guide terminal openings are mutually transversely offset. Enhancing the smooth feeding of flexible conduit provided by the aforesaid axes interrelationship, the tubular guide at terminal openings 82 and 83 is preferably of outwardly flared configuration.

In addition, the outwardly flared shape at tubular guide outlet-end 83 helps prevent manual slippage as the operator turns radial arm 70 at graspable guide 80 to effect conduit wind-up upon the non-rotatable spool It will be readily understood, however, that during conduit unwinding from the spool, the operator exerts a manual pull upon conduit lengths positioned forwardly of the tubular guide and does not touch the tubular guide.

As seen in FIG. 5, the alternate embodiment (80A) tubular guide comprises two removably attached components 80T and 80B abutting along seam line 80M and that respectively provide a portion of the curved-axis bore and at both terminal openings (82, 83). Upper component 80T includes an outward and apertured (85) protrusion 84. Alternate embodiment radial arm 70A differs from embodiment 70 in having an apertured (75) L-shaped first-end 74A. Thus, by virtue of screw 78 passing through apertures 75 and 85, and utilization of nut 79, tubular guide embodiment 80A might be rigidly attached to radial arm 70A at the correct angular interrelationship between axes 61 to 81. Upper component 80T is provied with an apertured lug 86, and lower component 80B is provided with a similar apertured lug 87. Screw 88 and nut 89 effect removalb attachment between the arm attached upper component 80t and the lower component 80B.

From the foregoing, the construction and usage of the portable reel concepts of the present invention will be readily understood and further explanation is believed to be unnecessary. However, since numerous modifications and changes will readily occur to those skiled in the art, it is not desired to limit the invention to the exact constructions shown and described, and accordingly, all suitable modifications and equivalents may be resorted to, falling within the scope of the appended claims.

What is claimed is as follows:

1. Portable reel for flexible conduits and comprising:

(A) a rearwardly positioned upright mount having directionally laterally separated ends including a top-end and a bottom-end;

(B) non-rotatable spool means attached to said mount and including a hub portion surrounding a horizontally extending longitudinal-axis, said spool means also incuding a frontal-rim extending radially from said longitudinal-axis and said hub and having an upright frontal-face, said frontal-rim being attached to said hub and being located a horizontally longitudinally extending finite-spacing forwardly of said mount, said radial frontal-rim extending both uprightly laterally and horizontally transversely from said longitudinal-axis;

(C) substantially colinear with and rotatable about said longitudinal-axis, a spindle attached to at least said spool means frontal-rim and including a spindle fore-length positioned forwardly of said frontal-rim;

(D) an elongate radial arm that is located substantially parallel to and frontally of said frontal-rim, said elongate arm being co-rotatably attached to said spindle fore-length, and said elongate arm including first-end located radially remote from said spindle fore-length and beyond the frontal-rim; and (E) a manually graspable tubular guide having a length-wise spine that is rigidly attached to said arm first-end, said tubular guide being provide with a curved-axis bore terminating as an outlet-opening located forwardly of said elongate arm and as an inlet-opening located rearwardly and radially inwardly of said frontal-rim, and said inlet-opening being transversely offset from said outlet-opening whereby when said radial arm first-end is stictly vertically below the spindle, the plan view angular relationship betweent he tubular guide curved-axis and said longitudinal-axis is withinthe range of 5° to 20°.

2. The portable reel of claim 1 wherein the tubular guide at the inlet-opening and at the outlet-opening is of outwardly flared configuration.

3. The portable reel of claim 1 wherein the upright mount takes the form of an upright bracket adapted to abut a wall, a post, and similar upright environments provided with a pair of forwardly horizontally extending headed extensions, said upright bracket having a forwardly extending top-end, a slotted bottom-end for removable anchoring to one said headed extension, and a keyhole aperture located nearer to the top-end than to the bottom-end and for removable anchoring to another said headed extension.

4. The reel of claim 2 wherein the upright mount takes the form of an upright bracket adapted to abut an upright environment provided with a pair of forwardly horizontal headed extensions, said upright bracket having a forwardly extending top-end, a slotted bottom-end for removable anchoring to one said headed extension, and a keyhole aperture for removable anchoring to another said heaed extension.

5. The portable reel of claim 1 wherein the spool means hub portion comprises a plurality of struts spanning the finite-spacing and being respectively removably attached to the upright mount and to the spool means frontal-rim.

6. The reel of claim 5 wherein the spool means frontal-rim comprises a plurality of generally co-planar elongate bars that intersect substantially at said longitudinal-axis.

7. The reel of claim 6 wherein the frontal-rim bars include a laterally extending upright-bar and a transversely extending horizontal-bar; and wherein two said struts occupying a common vertical plane attach the upright mount to said upright-bar, and wherein two said struts having angular C-shaped configurations and occupying a common horizontal plane removably attach the upright mount to said horizontal-bar.

8. The reel of claim 4 wherein the spool means frontal-rim comprises a plurality of generally co-planar elongate bars that intersect substantially at said longitudinal-axis; and wherein the spool means hub portion comprises a plurality of struts spanning said finite-spacing and being respectively removably attached to the upright mount and to the spool means frontal-rim.

9. The portable reel of claim 1 wherein the spool means upright frontal-rim comprises a plurality of generally co-planar elongate bars and together with an upright resinous frontal-plate attached to said frontal-rim and extending along the frontal-face thereof, said frontal-plate including a resinous bearing for the spindle.

10. The reel of claim 2 wherein the tubular guide is provided by two removably attached components that respectively provide a portion of the curved-axis type tubular bore and at both terminal openings thereof, one said components including an external protrusion for rigid attachment to the elongate arm first-end.

11. The reel of claim 10 wherein both components of the tubular guide are provided of resinous structural material; and wherein the two componentsare provided with external lugs for effecting said components' removable attachment.

12. The reel of claim 11 wherein the spool means hub comprises a plurality of struts spanning the finite-spacing and being respectively removable attached to the upright mount and to the spool means frontal-rim; and wherein the spool means frontal-rim comprises a plurality of generally co-planar intersecting elongate bars and together with a resinous frontal-plate that includes a resinous bearing for the spindle fore-length.

* * * * *